US010206458B2

(12) United States Patent
Foster et al.

(10) Patent No.: US 10,206,458 B2
(45) **Date of Patent: *Feb. 19, 2019**

(54) ARTICLE OF FOOTWEAR WITH TONGUE INCLUDING A PLURALITY OF LOOPS

(71) Applicant: Converse Inc., Boston, MA (US)

(72) Inventors: Brodrick Foster, Boston, MA (US); Aristides A. Membreño, Boston, MA (US)

(73) Assignee: CONVERSE INC., Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/885,968

(22) Filed: Feb. 1, 2018

(65) Prior Publication Data

US 2018/0153261 A1 Jun. 7, 2018

Related U.S. Application Data

(63) Continuation of application No. 14/848,935, filed on Sep. 9, 2015, now Pat. No. 9,907,360.

(51) Int. Cl.

| | |
|---|---|
| ***A43B 23/26*** | (2006.01) |
| ***A43C 1/00*** | (2006.01) |
| ***A43C 1/04*** | (2006.01) |
| ***A43C 5/00*** | (2006.01) |
| ***A43B 3/00*** | (2006.01) |
| ***A43C 11/20*** | (2006.01) |
| ***A43C 7/00*** | (2006.01) |

(52) U.S. Cl.

CPC ..... *A43C 1/04* (2013.01); *A43B 3/0078* (2013.01); *A43B 23/26* (2013.01); *A43C 1/00* (2013.01); *A43C 5/00* (2013.01); *A43C 7/00* (2013.01); *A43C 11/20* (2013.01)

(58) Field of Classification Search

CPC .... A43C 1/00; A43C 1/04; A43C 5/00; A43C 7/00; A43C 11/20; A43B 3/0078; A43B 23/26

USPC ..... 36/1, 50.1, 51, 54, 99, 100; 24/713.4, 24/713.6

See application file for complete search history.

(56) References Cited

U.S. PATENT DOCUMENTS

| | | | |
|---|---|---|---|
| 1,517,704 | A | 12/1924 | Canizaro |
| 1,619,322 | A | 3/1927 | Winn |
| 1,862,047 | A | 6/1932 | Boulet |
| 1,915,110 | A | 6/1933 | McLaughlin |
| 1,949,318 | A | 2/1934 | Markowsky |
| 2,007,157 | A | 7/1935 | Cockrum |
| 3,299,543 | A | 1/1967 | Merritt |
| 4,053,995 | A | 10/1977 | Shein |
| 5,088,166 | A | 2/1992 | Lavinio |
| D467,723 | S | 12/2002 | Gerber et al. |
| 7,818,898 | B1 | 10/2010 | Orengo |
| D707,954 | S | 7/2014 | DelVecchio |
| 8,869,432 | B1 | 10/2014 | Koo |
| 2004/0237348 | A1 | 12/2004 | Lacey |
| 2007/0227045 | A1 | 10/2007 | Aveni et al. |
| 2008/0083137 | A1 | 4/2008 | Aveni |

(Continued)

*Primary Examiner* — Jameson Collier

(74) *Attorney, Agent, or Firm* — Banner & Witcoff, Ltd.

(57) ABSTRACT

An article of footwear includes an outsole and an upper positioned above the outsole and including an opening having opposed edges thereof. A plurality of eyelets extends along the opposed edges of the opening, and a tongue extends from the upper into the opening. A plurality of rows of loops is found on an upper surface of the tongue, with each row containing a plurality of loops, and each row being positioned between a pair of opposed eyelets.

18 Claims, 4 Drawing Sheets

(56) References Cited

U.S. PATENT DOCUMENTS

| | | | |
|---|---|---|---|
| 2011/0023325 | A1 | 2/2011 | Wines et al. |
| 2011/0099844 | A1 | 5/2011 | Flannery |
| 2016/0106183 | A1 | 4/2016 | Roberson |
| 2016/0262495 | A1 | 9/2016 | Ramos |

ARTICLE OF FOOTWEAR WITH TONGUE INCLUDING A PLURALITY OF LOOPS

CROSS REFERENCE TO RELATED APPLICATIONS

This Application is a continuation application of application Ser. No. 14/848,935, filed Sep. 9, 2015, which is incorporated herein by reference.

FIELD

Aspects of this invention relate generally to an article of footwear, and, in particular, to footwear with a tongue having a plurality of loops through which lacing can be threaded.

BACKGROUND

Conventional articles of footwear such as athletic footwear include two primary elements, an upper and a sole assembly. The upper provides a covering for the foot that comfortably receives and securely positions the foot with respect to the sole assembly. In addition, the upper may have a configuration that protects the foot and provides ventilation, thereby cooling the foot and removing perspiration. The sole assembly is secured to a lower portion of the upper and is generally positioned between the foot and the ground. In addition to attenuating ground reaction forces, the sole assembly may provide traction, control foot motions (e.g., by resisting over pronation), and impart stability, for example. Accordingly, the upper and the sole assembly operate cooperatively to provide a comfortable structure that is suited for a wide variety of activities, such as walking and running. An insole may be located within the upper and adjacent to a plantar (i.e., lower) surface of the foot to enhance footwear comfort, and is typically a thin, compressible member.

The sole assembly may incorporate multiple layers. Some footwear includes only a midsole, while others may also include an outsole secured to a bottom surface of the midsole. The midsole, which is conventionally secured to the upper along the length of the upper, is primarily responsible for attenuating ground reaction forces. The midsole may also form the ground-contacting element of footwear. In such embodiments, the midsole may include texturing, such as projections and recesses or grooves, in order to improve traction. The outsole, when present, forms the ground-contacting element and may be fashioned from a durable, wear-resistant material.

The midsole may be primarily formed from a resilient, polymer foam material, such as ethyl vinyl acetate (EVA), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. In addition to polymer foam materials, conventional midsoles may include, for example, one or more fluid-filled bladders and moderators.

Figure 1:
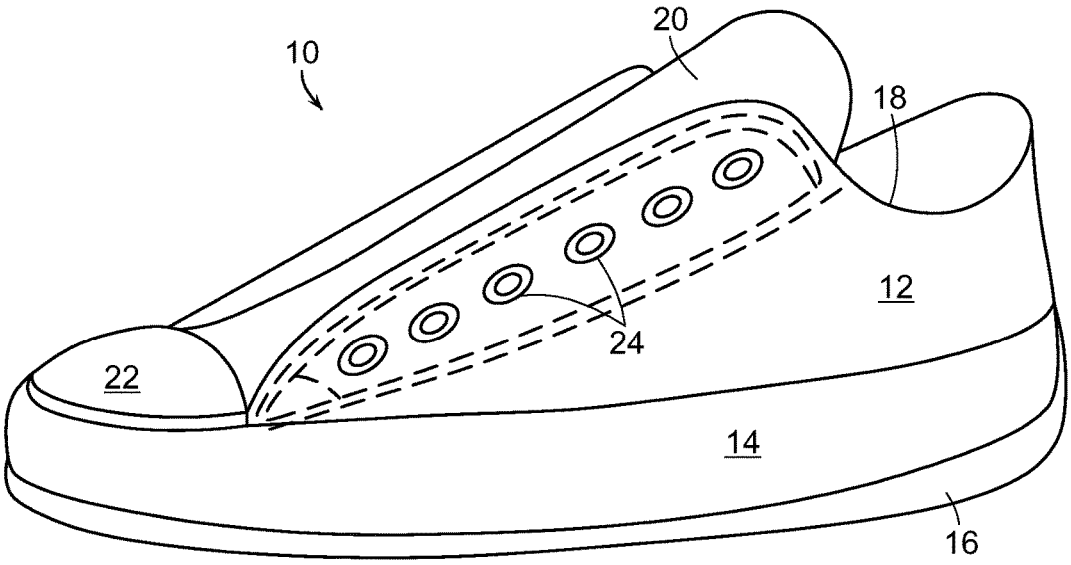
FIG. 1 is a perspective view of an article of footwear.

The figures referred to above are not drawn necessarily to scale, should be understood to provide a representation of particular embodiments, and are merely conceptual in nature and illustrative of the principles involved. Some features of the footwear depicted in the drawings have been enlarged or distorted relative to others to facilitate explanation and understanding. The same reference numbers are used in the drawings for similar or identical components and features shown in various alternative embodiments. Different embodiments of the footwear disclosed herein would have configurations and components determined, in part, by the intended application and environment in which they are used.

DETAILED DESCRIPTION OF CERTAIN EXEMPLARY EMBODIMENTS

The principles of the invention may be used to advantage to provide an article of footwear with a tongue having a plurality of loops through which lacing can be threaded. It would be desirable to provide an article of footwear with a tongue having lacing loops that reduces or overcomes some or all of the difficulties inherent in prior known devices.

In accordance with a first aspect, an article of footwear includes an outsole and an upper positioned above the outsole and including an opening having opposed edges thereof. A plurality of eyelets extends along the opposed edges of the opening, and a tongue extends from the upper into the opening. A plurality of rows of loops is found on an upper surface of the tongue, with each row containing a plurality of loops, and each row being positioned between a pair of opposed eyelets.

In accordance with another aspect, An article of footwear includes an outsole and an upper positioned above the outsole and including an opening having opposed edges thereof. A plurality of eyelets extend along the opposed edges of the opening. A tongue extends upwardly from the upper into the opening and has a longitudinal axis A plurality of rows of loops on an upper surface of the tongue extends transverse to the longitudinal axis of the tongue, each row containing a plurality of loops, and each row positioned between a pair of opposed eyelets. The loops are formed in a plurality of columns, each column comprising a strip of material secured to an upper surface of the tongue.

By providing an article of footwear with a tongue including a plurality of loops through which a lace or laces can be threaded, footwear with improved comfort and security as well as aesthetic appeal can be produced. These and additional features and advantages will be apparent to those skilled in the art, that is, those who are knowledgeable or experienced in this field of technology, in view of the following disclosure of the invention and detailed description of certain exemplary embodiments.

Figure 2:
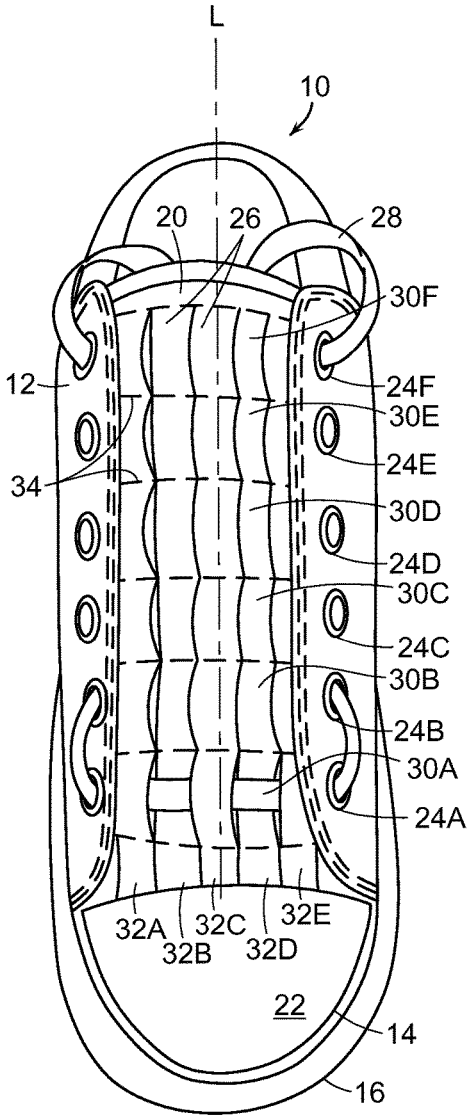
FIG. 2 is a plan view of the article of footwear of FIG. 1, showing a lace partially threaded through loops on the tongue of the footwear in a first configuration.
Figure 3:
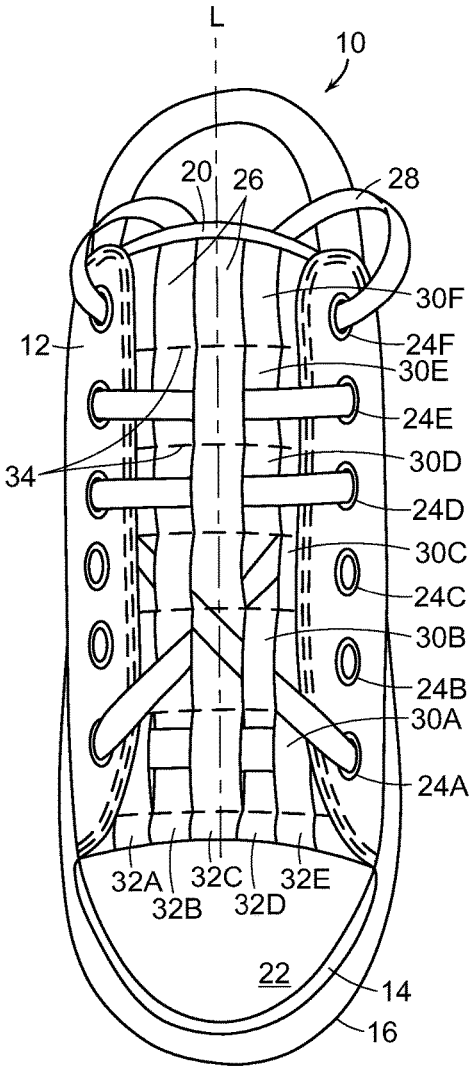
FIG. 3 is a plan view of the article of footwear of FIG. 1, showing a lace partially threaded through loops on the tongue of the footwear in a second configuration.

An article of footwear 10 is depicted in FIGS. 1-3. Footwear 10 may include an upper 12, a midsole 14, and an outsole 16. It is to be appreciated that in certain embodiments footwear 10 may not include a separate outsole 16, and that the bottom surface of midsole 14 may serve as the ground-engaging portion (or other contact surface-engaging portion) of footwear 10. Additionally, in certain embodiments, footwear 12 may not include a separate midsole 14, in which case upper 12 may be secured directly to outsole 16.

Upper 12 may define an opening 18 into which the user's foot is inserted. A tongue 20 may extend into opening 18 from a forefoot portion of upper 12. Tongue 20 may have a longitudinal axis L, that extends substantially parallel to a corresponding longitudinal axis of footwear 10. In certain embodiments, upper 12 may include a toe cap 22, and tongue 20 may extend rearwardly from a rear edge of toe cap 22.

A plurality of eyelets 24 may be positioned along opposed edges of opening 18. A plurality of loops 26 may be positioned on an upper surface of tongue 20. A lace 28, or multiple laces 28, may be threaded through one or more eyelets 24 as well as one or more loops 26. The threading of lace 28 through loops 26 helps to secure tongue 20 in place on the user's foot.

Loops 26 may be positioned in a plurality of rows 30, with each row extending between an opposed pair of eyelets 24 and extending transverse to longitudinal axis L. In the illustrated embodiment, footwear 10 includes six opposed pairs of eyelets 24A-F and, correspondingly six rows 30A-F of loops 26. It is to be appreciated that the number of pairs of eyelets 24 and corresponding rows 30 need not be six, and that any desired number of eyelet pairs and corresponding rows of loops can be positioned on footwear 10.

As illustrated in FIGS. 1-3, footwear 10 is a low-cut article of footwear. It is to be appreciated that footwear 10 could be a high-top article of footwear, such as is commonly used for basketball. In such a high-top embodiment, the number of eyelets and rows of loops could naturally be greater than six.

Additionally, loops 26 may be positioned in a plurality of columns 32. In the illustrated embodiment, five columns 32A-E are positioned on tongue 20. It is to be appreciated that tongue 20 can include any number of columns of loops 26.

In certain embodiments, loops 26 are formed of separate strips of material that are positioned on top of and secured to tongue 20. As seen here, loops 26 may be secured to an upper surface of tongue 20 by way of rows of stitching 34. Other suitable means for securing loops 26 to tongue 20 will become readily apparent to those skilled in the art, given the benefit of this disclosure.

In certain embodiments, loops 26 may be formed of individual strips of material secured at both ends thereof to tongue 20. In other embodiments, as illustrated here, each column 30 is a strip of material that is secured to tongue 20 at multiple locations, thereby defining a plurality of loops 26 that correspond to rows 30A-F.

In certain embodiments, loops 26 could constitute the entire thickness of tongue 20 and be defined by slits cut into tongue 20. Other suitable ways of forming loops 26 on tongue 20 will become readily apparent to those skilled in the art, given the benefit of this disclosure.

Loops 26 may be formed of any desired material, such as cotton or nylon, for example. Loops 26 may also have any desired color, as described in greater detail below.

By providing a plurality rows 30 of loops 26 in multiple columns 32, lace 28 (or multiple laces 28) can be threaded through loops 26 in different ways, allowing the user's foot to be more securely and comfortably positioned within footwear 10. Further, the user can thread lace 28 through loops 26 in a variety of patterns, thereby enhancing the aesthetics of footwear 10, and allowing the user to personalize their footwear.

As seen in FIG. 2, lace 28 is shown being threaded horizontally through only the lowermost row 30A, with lace 28 seen passing under loops 26 in columns 32A,C, and E, and over loops 26 in columns 32B and D.

As illustrated in FIG. 3, lace 28 is seen to be threaded through lowermost row 30A in the same fashion as seen in FIG. 2, and then extending diagonally upward from eyelets 24A to eyelets 24D, and being woven through selected loops 26 as it passes from eyelets 24A to eyelets 24D.

It is to be appreciated that lace 28 can be woven through loops 26 in any desired fashion. Lace 28 can be woven in a repeating pattern, as is done with conventional lacing and eyelets, but does not need to be so woven.

Figure 4:
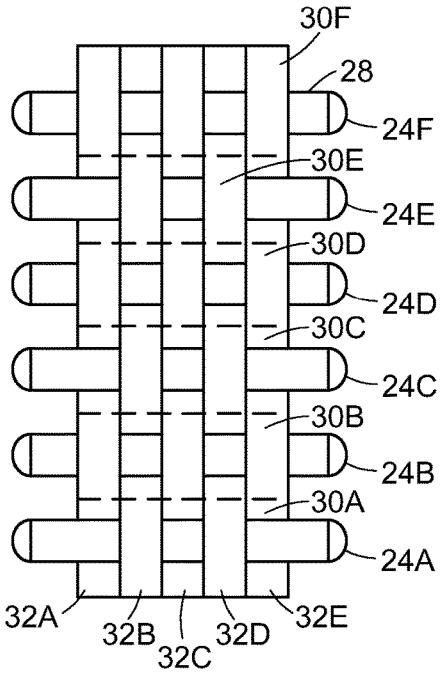
FIG. 4 is a schematic representation of a lace threaded through the loops on the tongue of the footwear of FIG. 1.

An embodiment of weaving lace 28 through loops 26 is illustrated in FIG. 4, which schematically shows one way of weaving lace 28. As seen here, lace 28 in rows 30A, C, and E extends over loops 26 of columns 32A, C, and E, and extends under loops 26 of columns 32B and D. Lace 28 in rows 30B, D, and F extends under loops 26 of columns 32A, C, and E, and over loops 26 in columns 32 B and D.

In this embodiment, lace 28 is woven over and under only one individual loop 26. It is to be appreciated that lace 28 can be woven over and under more than a single individual loop.

Figure 5:
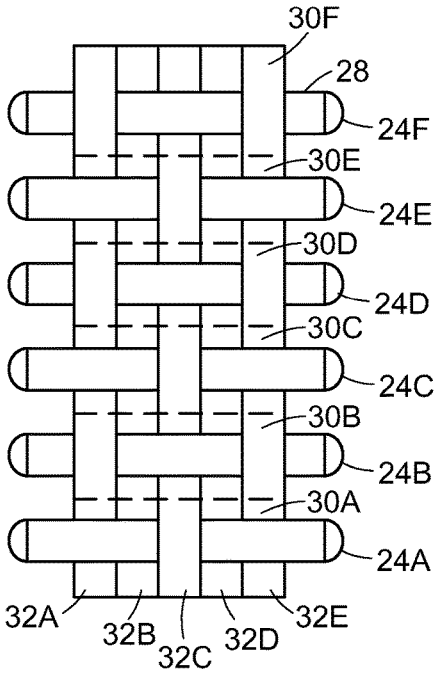
FIG. 5 is a schematic representation of another embodiment of a lace threaded through the loops on the tongue of the footwear of FIG. 1.

Another embodiment illustrating the weaving of lace 28 is seen in FIG. 5. In this embodiment, lace 26 is seen extending over and under more than one loop in a particular row. Specifically, lace 28 in rows 30A, C, and E extends over loops 26 in columns 32A, B, D, and E, and under loop 26 in column 32 C. Lace in rows 30B, D, and F extends under loops 26 in columns 32A and F and over loops 26 in columns 32B, C, and D.

In certain embodiments, some loops 26 may have different colors than other loops 26. Additionally, lace 28, or multiple laces 28, may also have any desired color. With loops 26 and lace 28 of different colors, the user can further optimize the look of footwear by threading lace 28 in a desired pattern.

In certain embodiments, the loops 26 in certain columns can have colors that are different than the color of loops 26 in columns adjacent to that column. For example, the loops in columns 32A, C and E could have a first color, while the loops 26 in columns 32B, and D could have a second color different than the first color. Lace 28 could have a third color, which could be different than both the first and second color, or the same as one of the first and second colors.

It is to be appreciated that each column 32 could have a different color than all of the other columns 32. It is also to be appreciated that the loops 26 in any column 32 need not all be the same color. Thus, for example, the loops 26 in one row 30 could have a color different than the color of loops 26 in rows adjacent to it. In other embodiments, loops of two adjacent rows 30 could have the same color, but be different than the colors of other rows 30.

Figure 6:
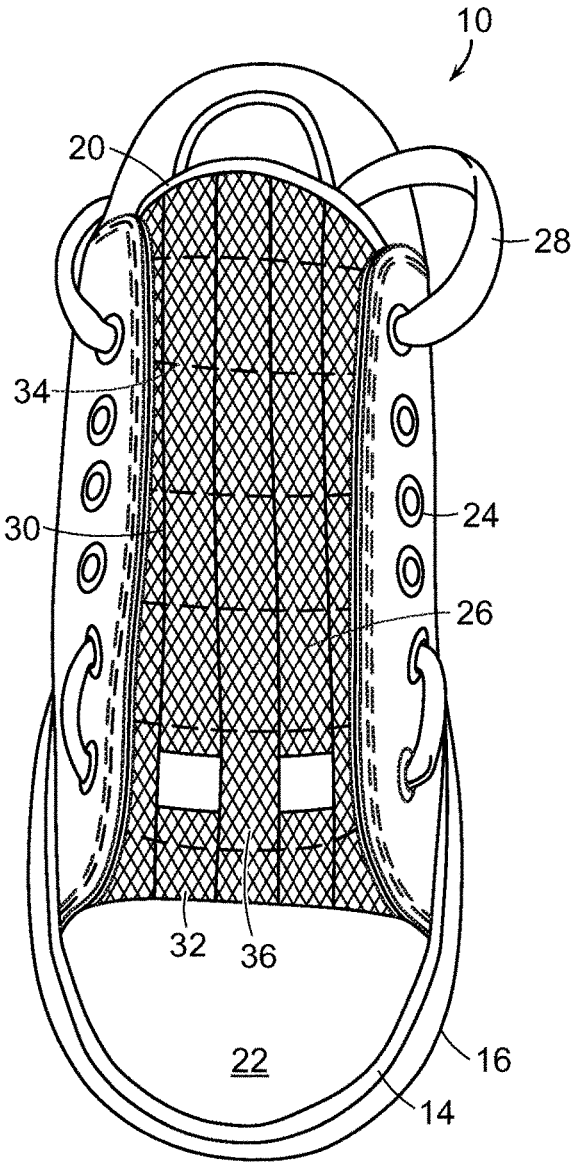
FIG. 6 is a plan view of an alternative embodiment of the loops on the tongue of the article of footwear of FIG. 1.

In other embodiments, loops 26 can include indicia thereon. For example, as seen in FIG. 6, a pattern 36 formed of different colors can be formed on loops 26. As illustrated here, a pattern of diagonally extending marks is seen extend across all of the loops 26. It is to be appreciated that the pattern, or indicia, need not extend across or be formed on all of the loops 26. That is, some loops could include no pattern or indicia while other loops could be completely or partially covered by a desired pattern or indicia.

Thus, it is to be appreciated that loops 26 and laces 28 can have any desired color or pattern formed thereon, and any combination of colors and/or patterns of loops 26 and laces 28 is considered to be possible.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising:

an upper including a longitudinally extending opening having opposed edges;

a plurality of eyelets extending along the opposed edges of the opening;

a tongue extending from the upper into the opening; and a plurality of rows of loops on an upper surface of the tongue, each row containing a plurality of loops, each loop in the respective row having an edge abutting an edge of an adjacent loop in the respective row, and each row positioned between a respective pair of opposed eyelets of the plurality of eyelets.

2. The article of footwear of claim 1, further comprising a midsole and an outsole, the midsole being positioned between the outsole and the upper.

3. The article of footwear of claim 1, wherein the plurality of loops are arranged in a plurality of columns.

4. The article of footwear of claim 3, wherein a color of each loop in one of the columns is different than a color of the loops in an adjacent column.

5. The article of footwear of claim 3, wherein the columns are strips of material secured to the upper surface of the tongue.

6. The article of footwear of claim 5, wherein the strips of material are secured to the tongue with stitching.

7. The article of footwear of claim 1, further comprising indicia formed on an outer surface of at least one of the loops on the tongue.

8. The article of footwear of claim 1, further comprising lacing threaded through at least some of the eyelets and at least some of the loops.

9. The article of footwear of claim 8, wherein a color of the lacing is different than a color of at least one of the loops.

10. The article of footwear of claim 8, wherein the lacing is threaded through at least one loop in one of the rows, and is not threaded through at least one loop in the one of the rows.

11. An article of footwear comprising:

an outsole;

an upper positioned above the outsole and including an opening having opposed edges;

a plurality of eyelets extending along the opposed edges of the opening;

a tongue extending upwardly from the upper into the opening and having a longitudinal axis; and a plurality of rows of loops on an upper surface of the tongue and extending transverse to the longitudinal axis of the tongue, each row containing a plurality of loops, each loop in the respective row having an edge abutting an edge of an adjacent loop in the respective row, and each row positioned between a respective pair of opposed eyelets of the plurality of eyelets, wherein the plurality of loops are formed in a plurality of columns, each column comprising a strip of material secured to the upper surface of the tongue.

12. The article of footwear of claim 11, further comprising a midsole positioned between the outsole and the upper.

13. The article of footwear of claim 11, wherein the strips of material are secured to the tongue with stitching.

14. The article of footwear of claim 11, wherein a color of each loop in one of the columns is different than a color of the loops in an adjacent column.

15. The article of footwear of claim 11, further comprising indicia formed on an outer surface of at least one of the loops on the tongue.

16. The article of footwear of claim 11, further comprising lacing threaded through at least some of the eyelets and at least some of the loops.

17. The article of footwear of claim 16, wherein a color of the lacing is different than a color of at least one of the loops.

18. The article of footwear of claim 16, wherein the lacing is threaded through at least one loop in one of the rows, and is not threaded through at least one loop in the one of the rows.

* * * * *